United States Patent [19]

Kuroi et al.

[11] 4,187,448

[45] Feb. 5, 1980

[54] DISCHARGE LAMP LIGHTING DEVICE

[75] Inventors: Hisashi Kuroi; Masayoshi Miyajima, both of Kyoto; Takao Matoba, Wakayama, all of Japan

[73] Assignee: Kuroi Kosan Co., Ltd., Kyoto, Japan

[21] Appl. No.: 858,473

[22] Filed: Dec. 7, 1977

[30] Foreign Application Priority Data

Dec. 13, 1976 [JP] Japan ..... 51-150133
Dec. 13, 1976 [JP] Japan ..... 51-150134
Dec. 13, 1976 [JP] Japan ..... 51-150135

[51] Int. Cl.[2] ..... H05B 37/00; H05B 39/00; H05B 41/00

[52] U.S. Cl. ..... 315/176; 315/206; 315/DIG. 2; 315/DIG. 5

[58] Field of Search ..... 307/72, 73, 75; 315/174, 176, 206, 209 R, 219, 224, DIG. 2, DIG. 5, DIG. 7

[56] References Cited

U.S. PATENT DOCUMENTS

| | | | |
|---|---|---|---|
| Re. 29,191 | 4/1977 | Harrigan | 307/75 |
| 3,323,012 | 5/1967 | Seib | 315/176 |
| 4,066,930 | 1/1978 | Summa | 315/DIG. 2 |
| 4,075,476 | 2/1978 | Pitel | 315/DIG. 5 |

*Primary Examiner*—Alfred E. Smith
*Assistant Examiner*—Robert E. Wise
*Attorney, Agent, or Firm*—Birch, Stewart, Kolasch and Birch

[57] ABSTRACT

Discharge lamps are connected to a commerical alternating current power supply through an impedance for blocking high frequency signals and an impedance compensating for the negative resistance of the discharge lamps. The discharge lamps are also connected to the commercial alternating current power supply through a rectifier and oscillator circuit, a voltage signal is generated including the commercial alternating current voltage superposed on a high-frequency, high-voltage signal from the oscillator. This voltage signal is applied to the discharge lamps to energize the same and maintain the lamps in a lighted condition.

7 Claims, 6 Drawing Figures

DISCHARGE LAMP LIGHTING DEVICE

BACKGROUND OF THE INVENTION

The present invention provides a light-weight, compact device for lighting discharge lamps, which is able to light discharge lamps to a stable condition without the use of a large-sized ballast of a heavy weight and large volume, and which is able to prevent damage to filaments in a discharge lamp, to thereby lengthen the life-time of the discharge lamps.

In a conventional discharge lamp lighting device, a ballast is inserted between the power supply terminals and the discharge lamps, so that a predetermined voltage is applied to the discharge lamps. However, since such a ballast is weighty and large-sized, a conventional discharge lamp lighting device itself has to also be formed in a large-size to accomodate the ballast. Because of their large-sized construction, discharge lamp lighting appliances are restricted by design, thereby no free choice in designing is available.

It is an object of the present invention to provide a lightweight and small-sized device for lighting discharge lamps to a stable condition without the use of a weighty and large-sized ballasts.

It is another object of the present invention to eliminate large noise signals, the necessity of the use of oscillation circuits capable of supplying large outputs resulting in expensive and large-sized lighting devices.

It is further object of the present invention to prevent damage to filaments in discharge lamps, thereby to lengthen the life-time of discharge lamps, by using a low-voltage output oscillation circuit and superposing the low-voltage output from the oscillation circuit on a commercial alternating current voltage.

It is still a further object of the present invention to reduce the number of polarity changes in the lamp energizing voltage as compared to the high-frequency, hign-voltage voltage drivers of the prior art to the number of polarity changes of the alternating current voltage.

BRIEF EXPLANATION OF THE DRAWINGS

Above and other objects of the present invention will be evident from the following detailed description when taken in conjunction with the accompanying drawings, in which.

DETAILED DESCRIPTION OF THE INVENTION

A first embodiment of a discharge lamp lighting device in accordance with the present invention will be described by referring to FIG. 1.

Figure 1:
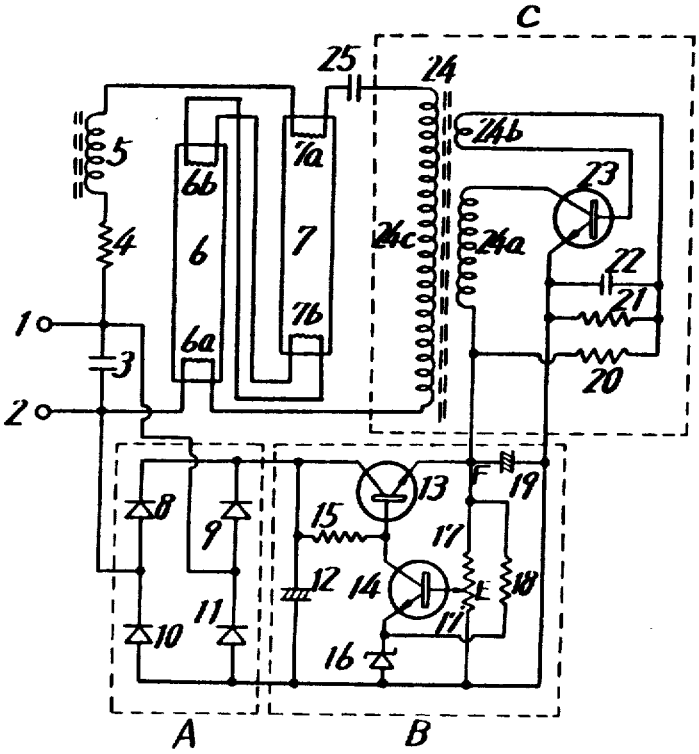
FIG. 1 is a schematic diagram of a first embodiment of a discharge lamp lighting device in accordance with the present invention.

In FIG. 1, a noise prevention condenser 3 is connected between terminals 1 and 2 of a commercial alternating current power supply. An impedance 4 for compensating for the negative resistance of discharge lamp 6, 7 is connected to the power supply terminal 1 and is also connected in series with an impedance 5 which blocks high frequency signals from the discharge lamps 6, 7. First and second discharge lamps, such as fluorescent lamps, are generally designated 6 and 7. One filament 6*a* of the first discharge lamp 6 is connected to the power supply terminal 2, and one filament 7*a* of the second discharge lamp 7 is connected to the power supply terminal 1 through a series circuit of the impedance 5 for blocking high frequency signals and impedance 4. The other filaments 6*b* and 7*b* of the first and second discharge lamps 6 and 7 are connected to each other.

Diodes 8, 9, 10 and 11 are bridge-connected and form a rectifier A, both input terminals of which are connected to the power supply terminals 1 and 2. A first filter condenser 12 for blocking a direct current is connected between the output terminals of the rectifier A. The collector of a first transistor 13 is connected to a positive output terminal of the rectifier A, and the collector of a second transistor 14 is connected to the base of the first transistor 13. A first resistance 15 is connected between the positive output terminal of the rectifier A and the base of the first transistor 13. A Zener diode 16 is connected between the emitter of the second transistor 14 and the negative output terminal of the rectifier A. A voltage adjusting potentiometer 17 is connected between the emitter of the first transistor 13 and the negative output terminal of the rectifier A, and an adjusting member 17' is connected to the base of the second transistor 14. A second resistance 18 is connected between the emitter of the first transistor 13 and the emitter of the second transistor 14. A second filter condenser 19 for blocking a direct current is connected between the emitter of the first transistor 13 and the negative output terminal of the rectifier A. A direct current stabilizing circuit B is thus constituted by the first and second transistors 13 and 14, the first and second filter condensers 12 and 19, the first and second resistances 15 and 18, the Zener diode 16 and the voltage adjusting potentiometer 17.

Third and fourth resistances 20 and 21 are connected in series and between the two terminals of the second filter condenser 19. A condenser 22 is connected in parallel with the fourth resistance 21. The emitter of an oscillating transistor 23 is connected to the negative output terminal of the rectifier A. A primary winding 24*a* of an oscillating transformer 24 is connected between the collector of the oscillating transistor 23 and the emitter of the first transistor 13. A feedback winding 24b of the oscillating transformer 24 is connected between the base of the oscillating transistor 23 and the connection of the third and fourth resistances 20 and 21. A secondary winding 24c of the oscillating trransformer 24 is connected between the filament *7a* of the second discharge lamp 7 through a commercial power supply blocking condenser 25 and the filament *6a* of the first discharge lamp 6. An oscillation circuit C is thus constituted by the oscillating transformer 24, the oscillating transistor 23, the condenser 22 and the third and fourth resistances 20 and 21.

Description will now be made of the operation of the first embodiment shown in FIG. 1.

Figure 2:
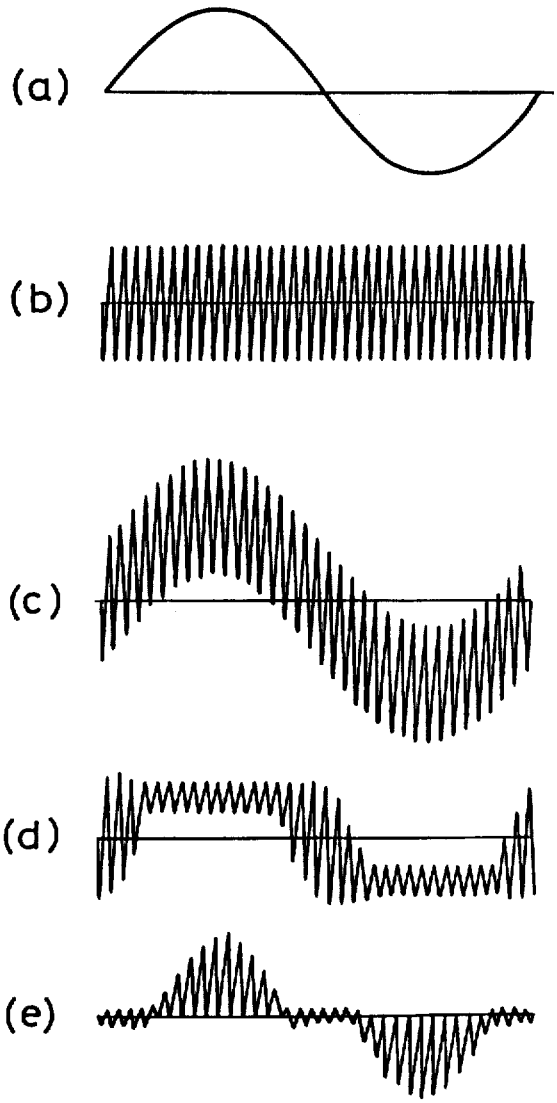
FIG. 2, ((*a*) to (*e*)) show waveforms of voltage or electric current of respective portions of FIG. 1, (*a*) being a waveform of a voltage from a commercial alternating current power supply, (*b*) being a wave form of output voltage from an oscillation circuit of the present invention, (*c*) being a wave form of a voltage signal resulting from the voltages shown in (*a*) and (*b*) being superposed, (*d*) being a waveform of a voltage across the terminals of a discharge lamp, and (*e*) being a waveform of a current in the discharge lamp of FIG. 1.

When a commercial alternating current voltage is applied to the terminals 1 and 2, an alternating current voltage as shown in FIG. 2(*a*) is applied between the filaments *6a* and *7a* of the first and second discharge lamps 6 and 7 through impedance 4 and high frequency blocking impedance 5. At this time, this voltage is divided between the filaments *6a* and *6b* of the discharge lamp 6, and the filaments *7a* and *7b* of the discharge lamp 7. Concurrently the commercial alternating current voltage is applied to the rectifier A so as to be fullwave-rectified and is supplied to the voltage stabilizing circuit B. In the voltage stabilizing circuit B the first filter condenser 12 is charged and the first transistor 13 is energized so that a current is generated in the voltage adjusting potentiometer 17 and a voltage applied across the terminals of the voltage adjusting potentiometer 17. When the voltage at the adjusting member 17' of the voltage adjusting potentiometer 17, namely, at the point E rises to a predetermined value, the second transistor 14 is energized, current flows through the collector of the second transistor 14 through the first resistance 15, the voltage at the base of the first transistor 13 is dropped and the first transistor 13 is deenergized. Consequently, the voltage at the emitter of the first transistor 13, namely, at the point F, drops, the second transistor 14 is then de-energized and the first transistor 13 is again energized. Repetition of the operations abovementioned permits regulation of the voltage at the point F to a constant value. Zener diode 16 keeps the voltage at the emitter of the second transistor 14 at a constant voltage, which is a reference voltage. Consequently, the voltage at the point F, namely, the output voltage from the voltage stabilizing circuit B, may be set at any value by moving the adjusting member 17' of the voltage adjusting potentiometer 17.

The direct current constant voltage supplied from the voltage stabilizing circuit B is applied to the oscillation circuit C, in which the primary winding of the oscillation transformer 24 is part of a relaxation oscillator circuit, and a high-frequency, high-voltage as shown in FIG. 2 (*b*), is generated at the secondary winding of the oscillation transformer 24, so as to be applied between the filament *6a* of the first discharge lamp 6, and the filament *7a* of the second discharge lamp 7. Thus, such high-frequency, high voltage is superposed on the commercial alternating current voltage, as shown in FIG. 2 (*c*). This superposed voltage applied between the filament *6a* of the first discharge lamp 6 and the filament *7a* of the second discharge lamp 7 lights both discharge lamps by a cold-cathod discharge. Then, between both discharge lamps 6 and 7 exhibit such voltage as shown in FIG. 2(*d*), and such current as shown in FIG. 2(*e*) to thereby keep the discharge lamps lighted. Namely, a voltage signal including a commercial alternating current voltage superposed on a high-frequency, high-voltage, is applied between the filament *6a* of the discharge lamp 6 and the filament *7a* of the discharge lamp 7, and cold-cathode discharge is generated between the other filament electrodes *6b* and *7b*, thus lighting the discharge lamps 6 and 7. After the discharge lamps 6 and 7 have been lighted, the negative resistances of the discharge lamps 6 and 7 are effectively changed to positive impedances, thereby to maintain the discharge lamps lighted on. When the voltage adjusting potentiometer 17 is varied thereby to change the voltage at the point F, namely the output voltage from the voltage stabilizing circuit B, the high frequency output from the oscillation circuit C may be changed thereby to control the current to be driven in the discharge lamps 6 and 7, so that the quantity or intensity level of light may be adjusted.

As thus described, in a discharge lamp lighting device in accordance with the present invention, discharge lamps are connected to commercial alternating current power supply terminals through an impedance combination for blocking high frequency and for compensating for the negative resistance of the discharge lamp. The discharge lamps are also connected to the commercial alternating current power supply terminals through a rectifier and an oscillation circuit for generating a high frequency, high-voltage signal. Thus, a voltage signal including a commercial alternating current voltage on which a a high frequency, high-voltage signal has been superposed is applied to discharge lamps 6, 7, to light the discharge lamps in a stable condition without using any ballast. Thus, the discharge lamp lighting device in accordance with the present invention may be formed in light-weight and compact package without design limitations.

When discharge lamps are lighted by only an output of a hign-frequency, high-voltage from an oscillation circuit, the output from the oscillation circuit must be very large and subsequently noise becomes high, so that a discharge lamp lighting device becomes expensive and large-sized. However, when the voltage supplied from the oscillation circuit is superposed on a commercial voltage, the output from the oscillation circuit may be smaller and more economical. Furthermore, as shown in FIG. 2, waveforms (*d*) and (*e*), the number of polarity changes is reduced compared to the case where discharge lamps are lighted by only a high-frequency high-voltage, and to such an extent as in the case of energization by a commercial power supply. The lower number of polarity changes minimizes damage to filaments of a discharge lamp, thus providing a longer life discharge lamp. Also the voltage supplied from the voltage stabilizing circuit may be varied by a potentiometer or the like to vary the output from the oscillation circuit to provide control of the current in the discharge lamps and illumination control.

Description will now be made of a second embodiment of the present invention applied to a discharge lamp lighting device, such as an emergency guide lamp which, when a commercial alternative curent power supply is cut off, is switched over to a direct current power supply, thereby to light discharge lamps.

Figure 3:
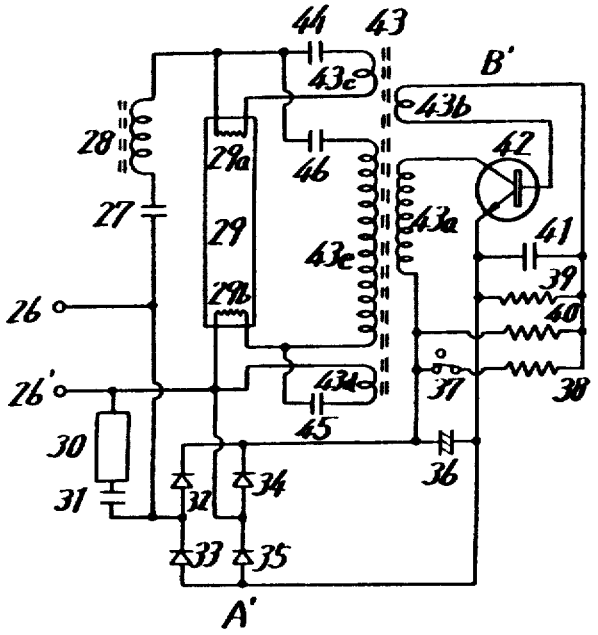
FIG. 3 is a schematic diagram of a second embodiment of a discharge lamp lighting device in accordance with the present invention.

Referring now to FIG. 3 showing a second embodiment, terminals of a commercial alternating current power supply are generally designated by 26 and 26', these terminals being switched and connected to a direct current power supply when the commercial alternating power supply is cut off. Direct current blocking impedance 27, compensating for negative resistance of a discharge lamp, is connected to the power supply terminal 26 and is also connected in series to a high frequency blocking impedance 28. A hot-cathode discharge lamp 29, such as a fluorescent lamp, has both filaments 29*a* and 29*b* connected to the power supply terminals 26 and 26' through direct current blocking impedance 27 and high frequency blocking impedance 28. Relay 30 and direct current blocking condenser 31 are connected in series to each other and also are connected between the power supply terminals 26 and 26'. Diodes 32, 33, 34 and 35 are bridge-connected and form a rectifier A', of which both input terminals are connected to the power supply terminals 26 and 26', respectively. A smoothing condenser 36 is connected between the output terminals of the rectifier A'. Relay Terminals 37 of the relay 30, a first resistance 28 and a second resistance 39 are connected in series to each other and are also connected between both terminals of the smoothing condenser 36. A third resistance 40 is connected in parallel with the series circuit comprising a first resistance 38 and the relay terminals; 37 of the relay 30. A condenser 41 is connected in parallel with the second resistance 39. The emitter and collector of oscillating transistor 42 are connected to the two terminals of the smoothing condenser 36, respectively, through the primary winding 43*a* of an oscillating transformer 43. Feedback winding 43*b* of the oscillating transformer 43 is connected between the base of the oscillating transistor 42 and the connection of the first resistance 38 and the second resistance 39. First and second preheating windings of the oscillating transformer 43 are generally designated by 43*c* and 43*d*, and lighting winding of the oscillating transformer 43 by 43*e*. Thus, an oscillation circuit B' for supplying a high-frequency, high-voltage to the secondary winding 43*e* is constituted by the oscillating transistor 42, the condenser 41, the first, second and third resistances 38, 39 and 40, and the relay terminal 37 of the relay 30. First and second commercial current voltage vlocking condensers 44 and 45 are connected to both terminals of each of the filaments 29*a* and 29*b* of a discharge lamp 29, respectively, through the first and second preheating windings 43*c* and 43*d* of the oscillating transformer 43. One end of a high frequency stabilizing impedance 46 is connected to the filament 29*a* of the discharge lamp 29, and another end is connected to the filament 29*b* of the discharge lamp 29 through the lighting winding 43*e* of the oscillating transformer 43.

Description will now be made of the operation of the sedcond embodiment shown in FIG. 3.

Figure 4:
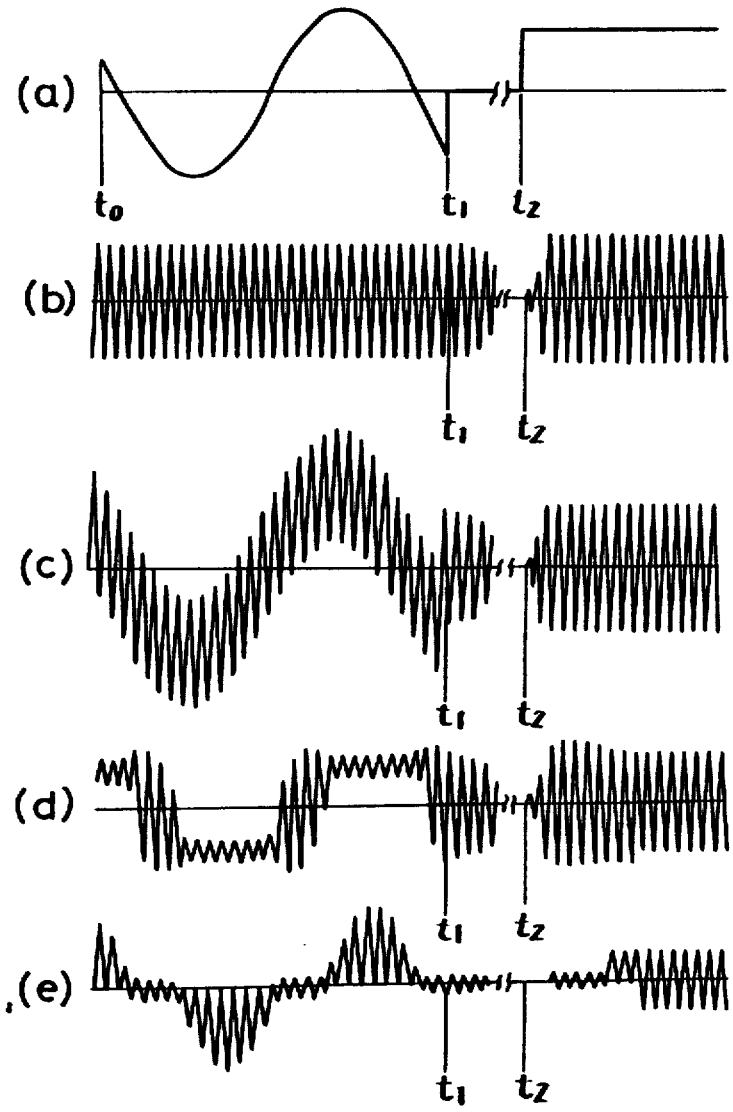
FIG. 4, ((*a*) to (*e*)) show waveforms of voltages or currents of respective portions of FIG. 3, (*a*) being a waveform of a voltage from a commercial alternating current power supply, (*b*) being a wave form of an output voltage from the oscillation circuit of FIG. 3, (*c*) being a waveform of a voltage signal resulting from the voltages shown in (*a*) and (*b*) being superposed, (*d*) being a waveform of a voltage across the terminals of a discharge lamp, and (*e*) being a wave form of a current in the energized discharge lamp of FIG. 3.

When a commercial alternating current voltage is applied to the power supply terminals 26 and 26', the voltage as shown in FIG. 4(*a*) is applied between the filaments 29*a* and 29*b* of the discharge lamp 29 through impedance 27 and high frequency blocking impedance 28. Concurrently, the commercial alternating current voltage is applied to the relay 30 through the direct current blocking condenser 31, thereby to open the relay terminals 37, and is applied to the rectifier A', so as to be supplied to the oscillation circuit B' after having been fullwave-rectified. In the oscillation circuit B', the primary winding of the oscillating transformer 43 is part of a well-known relaxation oscillation circuit and a high frequency, high voltage as shown in FIG. 4(*b*) is generated at the secondary winding 43*e* of the oscillating transformer 43. A commercial alternating current voltage is superposed on the high-frequency, high-voltage from the first and second preheating windings 43*c* and 43*d*, and the resulting superposed voltage as shown in FIG. 4(*c*) is applied between the filaments 29*a* and 29*b* of the discharge lamp 29. The filaments 29*a* and 29*b* are consequently pre-heated, and the discharge lamp 29 is lighted by the lighting winding 43*e*. After the discharge lamp 29 has been lighted, between the filaments 29*a* and there is exhibited the voltage, as shown in FIG. 4(*d*), and the current as shown in FIG. 4 (3). Thus, the negative resistance of the discharge lamp 29 is effectively changed to a positive impedance by the impedance 27, thereby to keep the discharge lamp 29 lighted in a stable condition. At this time, in the oscillation circuit B', the relay 30 is energized, so that the relay terminals 37 are opened and the first resistance 38 is disconnected. Consequently, bias voltage of the oscillating transistor 42 is small, so that the output from the secondary winding of the oscillating transformer 43 becomes small. Namely, since the discharge lamp 29 is lighted by a voltage on which a commercial alternating current voltage has been superposed, the output from the oscillation circuit B' may be reduced.

When the commercial alternating current power supply is cut off at a time t1, a direct current power supply, such as from reserve storage batteries, is connected to the power supply terminals 26 and 26' at a time t2, and such a voltage as shown in FIG. 4(*a*) will be applied to the terminals 26 and 26' after the time t2. This direct current voltage is not applied to the high frequency blocking impedance 28 because of presence of the direct current blocking impedance 27, and is applied to the oscillation circuit B' through the rectifier A'. At this time, the relay 30 is not energized because of presence of the direct current blocking condenser 31, and subsequently the relay terminals 37 are closed, so that the first resistance 38 is connected. Bias voltage from the oscillating transistor 42 is consequently large and as shown in FIG. 4(*b*) or (*c*) a high frequency voltage higher than the commercial alternating current voltage, is supplied from the oscillation circuit B'. The filaments 29*a* and 29*b* are then pre-heated by the first and second pre-heating windings 43*c* and 43*d*, and the discharge lamp 29 is lighted on after the time t2 by the lighting winding 43*e*, and between the filaments 29*a* and 29*b* such voltage as shown in FIG. 4(*a*) is generated and such current as shown in FIG. 4(*e*) flows therethrough.

Description will now be made of a third embodiment of the present invention with reference to FIG. 5.

Figure 5:
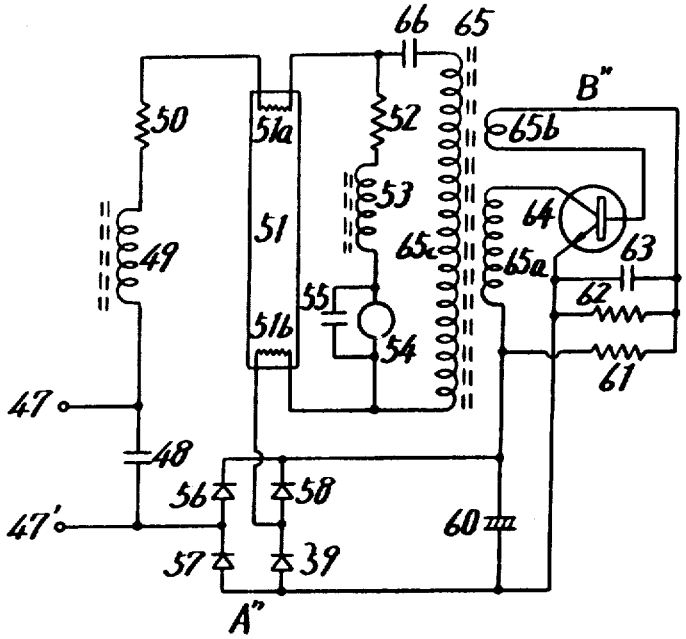
FIG. 5 is a schematic diagram of a third embodiment of a discharge lamp lighting device in accordance with the present invention.

In FIG. 5, terminals of a commercial alternating current power supply are generally designated by 47 and 47'. Noise prevention condenser 48 is connected between the power supply terminals 47 and 47'. A high frequency blocking impedance 49 is connected to the power supply terminal 47 and is also connected in series to impedance 50 compensating for negative resistance of a discharge lamp 51.

One end of a filament 51*a* of the discharge lamp 51, such as a fluorescent lamp, is connected to the power supply terminal 47 through the impedance 50 and the high frequency blocking impedance 49. Current-limit resistance 52, high frequency blocking choke coil 53 and a starting element 54, such as glow-discharge tube, are connected in series to each other and also connected between the other end of the filament 51*a* and one end of the other filament 51*b*. Noise prevention condenser 55 is connected in parallel with the starting element 54. First, second, third and fourth diodes 56, 57, 58 and 59 are bridge-connected and form a rectifier A'', of which both inpute terminals are connected to the other end of the filament 51*b* and to the power supply terminal 47′, respectively. Smoothing condenser 60 is connected between the output terminals of the rectifier A″. First and second resistances 61 and 62 are connected in series to each other and also connected between the output terminals of the rectifier A″. Condenser 63 is connected in parallel with the second resistance 62. Emitter and collector of the oscillating transistor 64 are connected to the output terminals of the rectifier A″, respectively, through the primary winding 65*a* of oscillating transformer 65. Feedback winding 65*b* of oscillating transformer 65 is connected between the base of the oscillating transistor 64 and the connection of the first and second resistances 61 and 62. Secondary winding of the oscillating transformer 65 is generally designated by 65*c*. An oscillation circuit B″ is thus constituted by the oscillating transformer 65, the oscillating transistor 64, the condenser 63 and the first & second resistances 61 & 62. One end of commercial alternating current voltage blocking condenser 66 is connected to said other end of the filament 51*a*, and the other end of the condenser 66 is connected to said one end of the filament 51*b* through the secondary winding 65*c* of the oscillating transformer 65.

Description will now be made on the operation of the third embodiment shown in FIG. 5.

Figure 6:
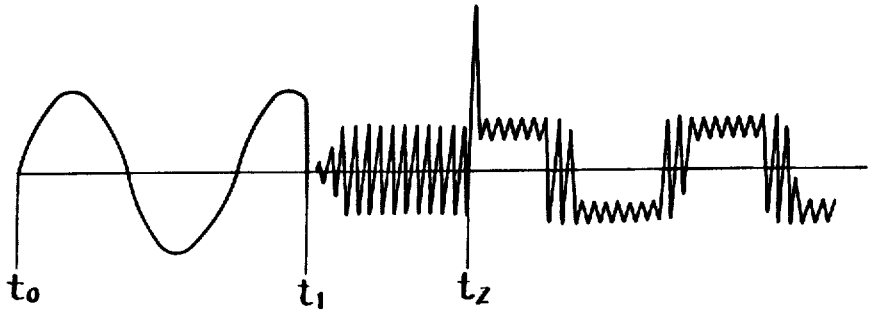
FIG. 6 shows a waveform of a voltage across the terminals of the discharge lamp of Figures.

When a commercial alternating current voltage is applied to the power supply terminals 47 and 47′. A current is applied from the power supply terminal 47 to the other power supply terminal 47′ through high frequency blocking impedance 49, impedance 50, filament 51*a*, current-limit resistance 52, high frequency blocking choke coil 53, starting element 54, other filament 51*b*, third diode 58, primary winding 65*a*, oscillating transistor 64 and second diode 57. Such voltage as shown between $t_o$ and $t_1$ in FIG. 6 is applied between the filments 51*a* and 51*b* of the discharge lamp 51, thereby to pre-heat the filaments 51*a* and 51*b*. At this time, a current, after having been fullwave-rectified at the rectifier A″, is applied to the oscillating transistor 64 in the oscillation circuit B″, but the oscillation circuit B″ is not operated during the time which the starting element 54 is discharging. When the electrodes of the starting element 54 are connected at the time $t_1$, the oscillation circuit B″ is operated by a direct current voltage from the rectifier A″. In the oscillation circuit B″, the primary winding of the oscillating transformer 65 is part of a relaxation oscillation circuit, as of a well-known type, and a high-frequency, high-voltage is generated at the secondary winding 65*c* of the oscillating transformer 65. Namely, such voltage as shown between $t_1$ and $t_2$ in FIG. 6 is applied between the filaments 51*a* and 51*b*, thereby to further pre-heat the filaments 51*a* and 51*b*. When the electrodes of the starting elements 54 are disconnected at the time $t_2$, a kick voltage of a high amplitude, is generated, so that the discharge lamp 51 of which filaments 51*a* and 51*b* have been pre-heated, is lighted immediately. After the discharge lamp has been lighted. A voltage signal including the commercial alternating current voltage superposed on the high-frequency, high-voltage is generated, as shown in FIG. 6. After the time $t_2$, this voltage signal is applied between the filaments 51*a* and 51*b*. Negative resistance of the discharge lamp 51 is effectively changed to a positive impedance by impedance 50, so that the discharge lamp 51 is kept lighted. Namely, without using any ballast, in a stable condition the discharge lamp 51 may be lighted and maintained lighted.

What is claimed is:

1. A circuit for turning ON a discharge lamp means and maintaining said discharge lamp means ON for an ON period of a selected duration, said discharge lamp means having a characteristic negative impedance, the improvement comprising:

first impedance means in a series loop with said discharge lamp for effectively canceling said negative impedance of said discharge lamp in said series loop when said discharge lamp is ON;

power supply means for generating a low frequency alternating current voltage commensurate with commercial power amplitude and frequency values;

means for applying said alternating current voltage from said power supply across said discharge lamp;

oscillator means for generating a high frequency alternating current voltage;

means for superposing said high frequency alternating current voltage on said low frequency alternating current voltage across said discharge lamp means during the entire ON period of said discharge lamp; and second impedance means in said series loop between said discharge lamp means and said power supply for blocking high frequency voltages but passing the low frequency alternating current voltage of said power supply to said discharge lamp means;

whereby said discharge lamp means is maintained ON by the superposed alternating current voltages of said power supply means and said oscillator means.

2. The circuit of claim 1 further including rectifier means coupling said power supply means to said oscillator means for providing a direct current bias voltage to said oscillator means.

3. The circuit of claim 2 further including voltage regulator means for maintaining said direct current bias voltage substantially constant.

4. The circuit of claim 3, further including adjusting means for varying the voltage maintained by said voltage regulator means for adjusting the quantity of light emitted by said discharge lamp means.

5. A circuit for turning ON a discharge lamp means and maintaining said discharge lamp means ON for an ON period of a selected duration, said discharge lamp means having a characteristic negative impedance, the improvement comprising:

first impedance means in a series loop with said discharge lamp for effectively canceling said negative impedance of said discharge lamp in said series loop when said discharge lamp is ON;

a primary power supply means for generating a low frequency alternating current voltage commensurate with commercial power amplitude and frequency values;

means for applying said alternating current voltage from said primary power supply means across said discharge lamp;

oscillator means for generating a high frequency alternating current voltage;

rectifier means coupled between said primary power supply means and said oscillator means for supplying a direct current bias voltage to said oscillator means;

means for superposing said high frequency alternating current voltage on said low frequency alternating current voltage across said discharge lamp means;

second impedance means in said series loop between said discharge lamp means and said primary power supply for blocking high frequency voltages but passing the low frequency alternating current voltage of said primary power supply means to said discharge lamp means;

auxillary direct current power supply means for supplying direct current bias voltage to said oscillator means in the absence of the generation of power from said primary power supply means; and third impedance means for blocking the application of direct current voltage from said auxillary power supply means to said discharge lamp means;

whereby in the absence of the generation of said low frequency alternating current voltage from said primary power supply means said discharge lamp means is maintained ON by the high frequency alternating current voltage generated by said oscillator means.

6. A circuit for turning ON a discharge lamp means and maintaining said discharge lamp means ON for an ON period of a selected duration, said discharge lamp means having a characteristic negative impedance, the improvement comprising:

first impedance means in a series loop with said discharge lamp for effectively canceling said negative impedance of said discharge lamp in said series loop when said discharge lamp is ON;

power supply means for generating a low frequency alternating current voltage commensurate with commercial power amplitude and frequency values;

means for applying said alternating current voltage from said power supply across said discharge lamp;

oscillator means for generating a high frequency alternating current voltage;

means for superposing said high frequency alternating current voltage on said low frequency alternating current voltage across said discharge lamp means during the entire ON period of said discharge lamp;

second impedance means in said series loop between said discharge lamp means and said power supply for blocking high frequency voltages but passing the low frequency alternating current voltage of said power supply to said discharge lamp means; and starter means responsive to energy generated by said oscillator means for generating a high voltage starter pulse a predetermined period of time after said oscillator means begins to oscillate;

whereby said discharge lamp means is turned ON by said starter means and is maintained ON by the superposed alternating current voltages of said power supply means and said oscillator means.

7. The circuit of claim 6, further including warm-up means energizing by said power supply means for warming up said discharge lamp means prior to the generation of said high voltage starter pulse.

* * * * *